US005199368A

United States Patent [19]

Souda

[11] Patent Number: 5,199,368

[45] Date of Patent: Apr. 6, 1993

[54] SMALL SHIP HAVING OUTER SHELL FORMED BY PLASTIC DEFORMATION AND METHOD OF PRODUCING SAME

[75] Inventor: Takeshi Souda, Toyoake, Japan

[73] Assignee: Toyota Jidosha Kabushiki Kaisha, Toyota, Japan

[21] Appl. No.: 860,219

[22] Filed: Mar. 27, 1992

Related U.S. Application Data

[63] Continuation of Ser. No. 634,041, Dec. 26, 1990, abandoned.

[30] Foreign Application Priority Data

Dec. 27, 1989 [JP] Japan ..... 1-151177[U]
Dec. 27, 1989 [JP] Japan ..... 1-340497

[51] Int. Cl.[5] ..... B63B 3/06

[52] U.S. Cl. ..... 114/65 R; 114/77 R; 114/79 W; 114/88; 114/140

[58] Field of Search ..... 114/77 R, 65 R, 88, 114/79 R, 79 W, 140

[56] References Cited

U.S. PATENT DOCUMENTS

| | | | |
|---|---|---|---|
| 1,364,626 | 1/1921 | Ewertz | 114/79 W |
| 1,823,699 | 9/1931 | Norton et al. | 114/79 W |
| 1,891,602 | 12/1932 | Neill . | |
| 2,279,234 | 4/1942 | Heckman | 114/79 W |
| 2,465,251 | 3/1949 | Meier | 114/79 W |
| 2,980,049 | 4/1961 | Ward et al. | 114/140 |
| 4,457,249 | 7/1984 | Disen | 114/88 |

FOREIGN PATENT DOCUMENTS

| | | | |
|---|---|---|---|
| 4138478 | 10/1979 | Australia . | |
| 2432428 | 4/1980 | France | 114/79 R |
| 61-75088 | 4/1986 | Japan . | |
| 8200313 | 2/1982 | PCT Int'l Appl. . | |

*Primary Examiner*—Sherman Basinger
*Attorney, Agent, or Firm*—Cushman, Darby & Cushman

[57] ABSTRACT

A small ship made of plurality of prefabricated sections, which are made at a factory by a plastic deformation process, such as stamping or rolling, and of a dimension, size and shape such that an overland transportation by road thereof is possible. The sections are transported to a site located at a coastal zone, and connected to each other thereat to thereby build a ship.

6 Claims, 5 Drawing Sheets

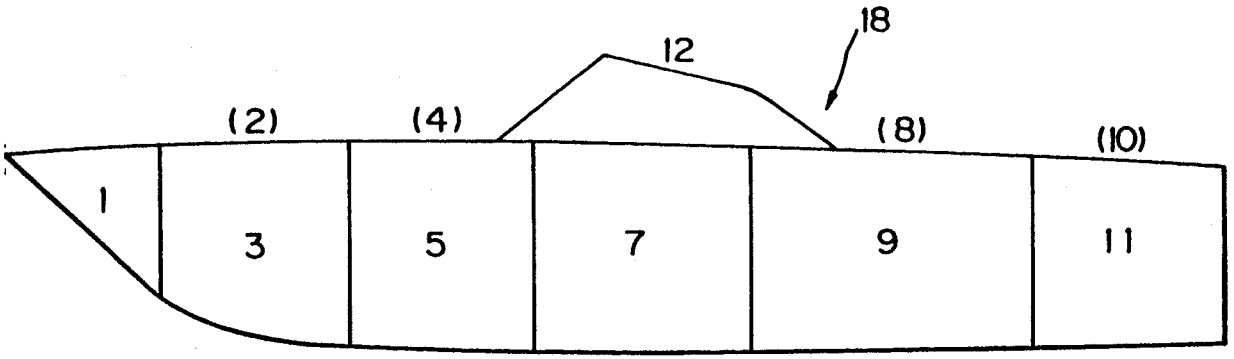
Fig.1-(a)
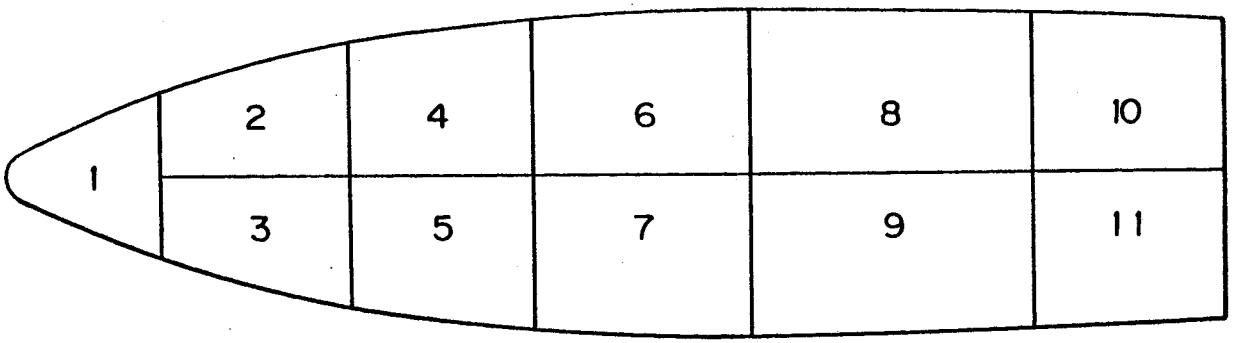
Fig.1-(b)
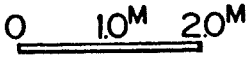

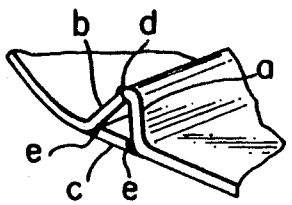
Fig.5-(A)
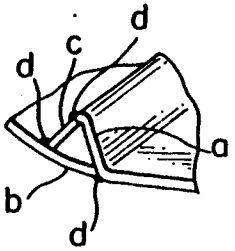
Fig.5-(B)
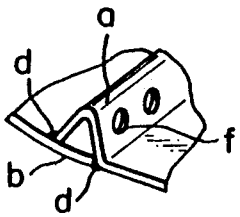
Fig.5-(C)
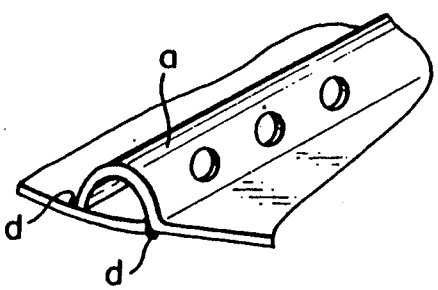
Fig.5-(E)
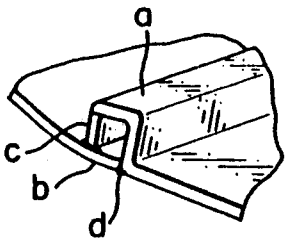
Fig.5-(D)

SMALL SHIP HAVING OUTER SHELL FORMED BY PLASTIC DEFORMATION AND METHOD OF PRODUCING SAME

This is a continuation of application Ser. No. 07/634,041, filed on Dec. 26, 1990, which was abandoned.

BACKGROUND OF THE INVENTION

1. Field of the Invention

The present invention relates to a novel structure of a small ship, in particular, to a construction of a small ship able to be built from prefabricated units. The term small ship as used in this specification refers to ships used mainly for leisure activities or sightseeing, or to small fishing boats.

2. Description of the Related Art

The construction of small ships is divided roughly into two types, as explained hereinbelow.

In the first type of construction, a shape of the ship is molded from a plastic material and allowed to solidify. Then the molded plastic shape is laminated with a reinforcing material, such as a glass fiber, whereby the shell of the ship is obtained. The shell is then usually strengthened, from the inside, by strengthening members such as a keel, cross members, and bulkheads.

In the second type of construction, a skeletal structure such as a keel and cross members is first fixed together, and the shell is then fixed to the skeletal structure. Plates of, for example, wood, steel or aluminum are used as the shell. An example of this type of construction is a ship built by a strip-planking method. The first type of construction is widely used, since mass production becomes possible once a mold is made. Nevertheless, this method has a drawback in that much labor is required for the curing of the plastic material to obtain a laminated reinforced material, using, for example, glass fibers, and this drawback is accompanied by a difficulty in maintaining good working environmental conditions. Furthermore, the thus-built ship body will last long after the service life of the ship is exhausted, and it is difficult to dispose of the body, thus causing a drawback in that it cannot be recycled.

Furthermore, if the size of the ship body is increased, the making of the mold becomes complicated, and thus a reduction of a manufacturing cost cannot be obtained unless mass production is possible.

The second type of construction provides less freedom with regard to the shape of the ship which can be built, because the shell is fixed to the prefabricated skeletal structure. From the viewpoint of maintenance, an aluminum ship is advantageous, but a problem arises in that the building costs are high in comparison with those of the FRP ship, when the prior construction type is employed. In the case of the aluminum ship, in particular, an enormous affect is exerted by a distortion generated when welding is done, whereby the number of working units must be increased to eliminate the distortion.

Both of types of construction must be used in coastal zones when the ship, even if small, is of a size that makes overland transportation difficult (a ship having a length of more than 2.5 meters is very difficult to transport overland), and thus the number of shipbuilding sites is limited, and sometimes there is insufficient manpower available at the site.

SUMMARY OF THE INVENTION

Therefore, an object of the present invention is to provide a construction of a ship of which a substantial part thereof can be built at a site other than a coastal zone, to thereby reduce the amount of construction work to be carried out at the coastal zone, and by which a ship shell having a precise and desired shape can be obtained.

According to a first aspect of the present invention, a small ship is provided which comprises a plurality of prefabricated sections having a predetermined size and shape suitable for overland transportation, the sections being welded together to obtain a shell of the ship, each of the sections comprising at least one outer plate member obtained by a plastic deformation process.

This type of construction enables a small ship to be built from prefabricated sections which are transportable overland, and thus such a ship can be built regardless of regional limitations.

Furthermore, since the outer plates constructing the outer shell member of the ship can be preformed to a desired curved surface by a plastic deformation process, such as stamping or rolling, a desired shape of the ship can be easily obtained.

According to the second aspect of the present invention, a method of building a small ship is provided, which comprises the steps of:

producing separate sections of a size suitable for overland transportation;

transporting the separate sections overland to a location at which the ship is to be built, and;

connecting the transported separate sections to each other to form a shell of the small ship.

This method allows the sections to be produced at an area other than a coastal zone, and only a connecting step is required at the coastal zone to obtain a ship.

BRIEF DESCRIPTION OF DRAWINGS

FIGS. 1-(*a*) and 1-(*b*) are schematic side and plane views, respectively, of a ship produced in accordance with the construction method of the present invention, and sections used for producing same;

FIG. 5 (*a*) to (*e*) show various examples of the methods of connecting the outer panels which form the shell of the ship.

DESCRIPTION OF THE PREFERRED EMBODIMENTS

An embodiment of the present invention will be now described. FIG. 1-(*a*) and (*b*) schematically illustrate sections 1 to 12 by which a small ship 18 is built. The ship 18 is built by a total of eleven ship sections 1 to 11 and one pilot house section 12. Each of the sections 1 to 12 has a maximum width of less than 2.5 meters, so that overland transportation is possible without special permission as stipulated in the Japanese Load Transportation Vehicle Law, Safety Rules, Article 2.

Figure 2:
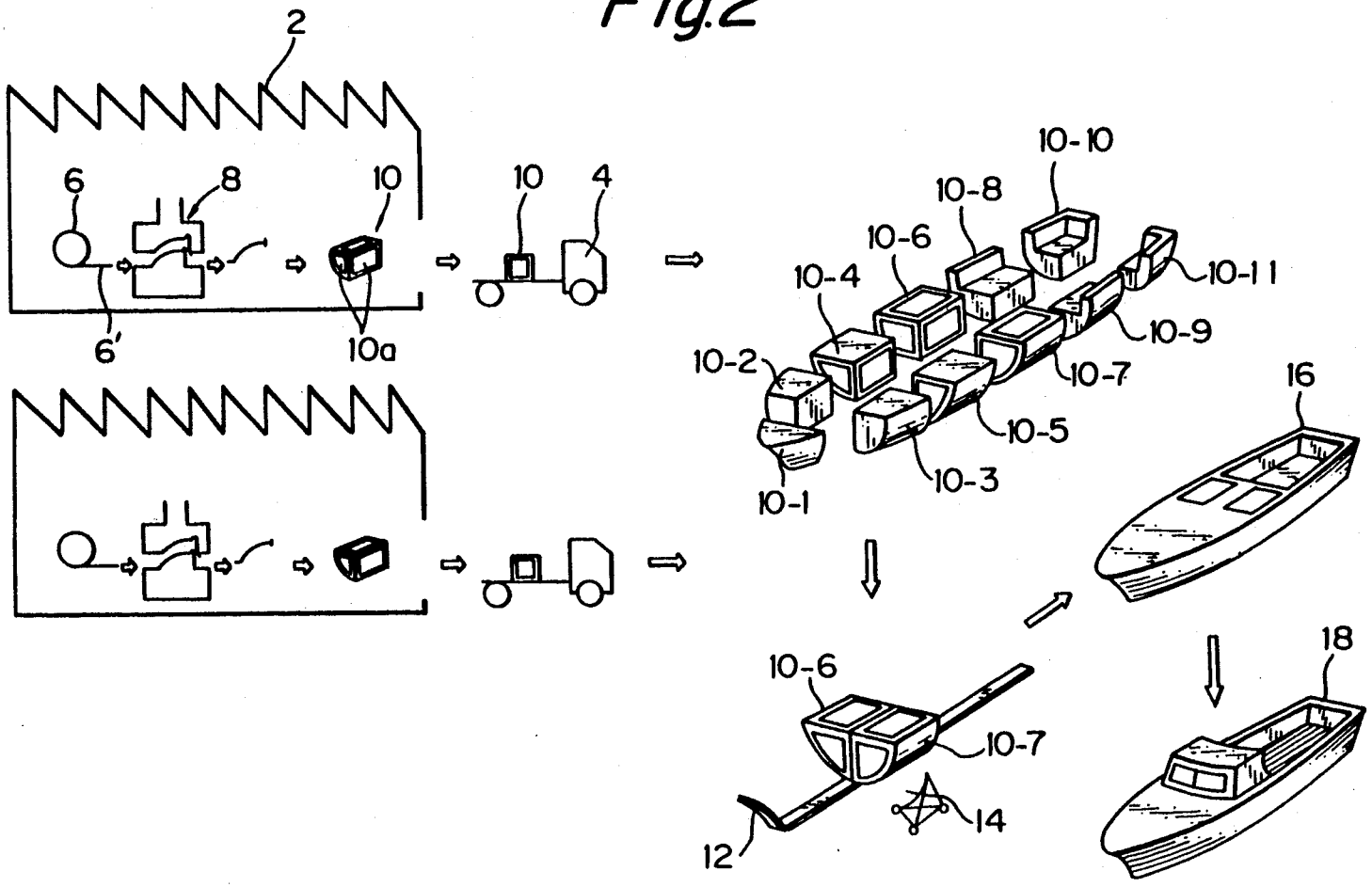
FIG. 2 is a schematic view of process for obtaining the ship.

FIG. 2 is a schematic diagram of a process for obtaining a ship according to the present invention.

In this drawing, reference numeral 2 denotes a factory for producing the prefabricated sections. In this factory 2, an aluminum plate 6' taken from a roll 6 is stamped by a process 8 to produce outer plates which form a shape of each of the sections. During this process, a production technique and automated technique employed for the production of automobiles can be used. Instead of the stamping process, a rolling or other plastic processing technique by which the plate members can be subjected to a plastic deformation to obtain a desired shape, may be employed. Typically, each of the sections 10 is composed of a plurality of plates obtained by the plastic deformation process. These plates are welded together to form a desired shape of the section.

In this case, since each of the sections has a maximum width of 2.5 meters, i.e., is within the range permitted by said safety rules, it is possible to obtain a shape of each of the sections along a desired curved surface, which increase the freedom of the design of the shape, compared with an aluminum boat based on the conventional construction method.

Furthermore, according to this type of construction, preferably the sections are made in such a manner that they form the bulkheads dividing the ship, i.e., the sections are closed at all side walls thereof made of aluminum plate, making it easy to maintain a desired precision of the shape of the sections. It is, of course, possible to provide openings 10*a* at the side walls (bulkheads) of each of the sections, wherever necessary.

When necessary, a skeletal strengthening structure 20 is fixed inside each of the sections. The welding of the outer plates, the welding of the outer panels to the skeletal strengthening structures, or the welding between the skeletal strengthening structures, may be automated to a great extent by employing, for example, a laser welding method.

Note, the end portions of the outer plates of each of the sections are provided with a flange having a particular shape, to facilitate a connection of one plate to an adjacent plate of the sections. This will be described later in relation to FIGS. 3 and 4. This construction is particularly advantageous when building an aluminum boat, but can be adopted when building a steel ship.

The thus prefabricated sections are transported overland by trucks 4 to a shipbuilding site located at the coast.

At the ship building site, the strength required for a ship and the strength obtained when the sections are connected to each other are compared, and when it is determined that a required strength cannot be obtained, longitudinal members, such as a keel 12, are used for strengthening the structure. The sections as transported are connected to the keel 12 and to each other. This is accomplished by using a laser welding machine 14.

The use of the laser welding machine 14 ensures that the welding deformation is relatively suppressed to a very small value. Furthermore, little welding traces appear, and thus the usual process for correcting welding traces is made easier. According to this construction, the welding points are located substantially on one plane, and thus the laser welding can be employed over a wide range and can be easily automated. Even if a conventional welding technique is used, the location of the welding spots substantially in one plane allows an easier automation thereof.

After the major portion of the body of the ship is thus constructed, the interior work, for example, decoration, is carried out to finally obtain a small ship 18. Note, the interior decoration work can be partly done at the factory 2.

A method of connecting the sections will be described in detail.

Figure 3:
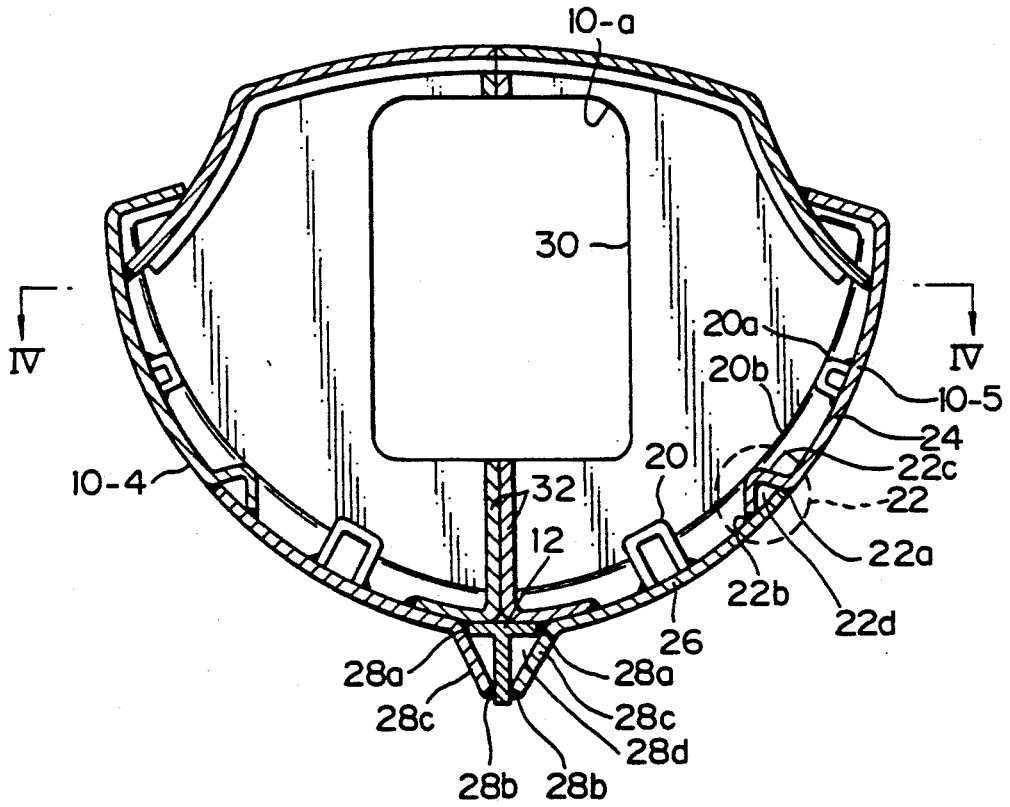
FIG. 3 is a transverse cross sectional view of a ship according to the present invention.

FIG. 3 shows a method of connecting the sections 10-4 and 10-5.

Each of sections blocks 10-4 and 10-5 in this embodiment is formed by two aluminum plates 24 and 26, which are connected to each other by a strengthening structure 22 having a closed shape. This structure 22 25 comprises a longitudinally extending, inwardly recessed flange portion 22*c* on one end of the plate 24. This flange portion 22*c* is connected to the end face of the second plate 26 at welding points 22*a* and 22*b*, such that a space 22*d* is formed. The flange portion 22*c* of the skeletal strengthening structure 22 i preferably formed at the same time as the plates 24 and 24 are stamped or rolled at the factory 2. This welding at the points 22*a* and 22*b* can be done at the factory 2 when the section is made. Note, this skeletal strengthening structure 22 can provide a desired strength even if it has a partly open construction. In addition to this skeletal strengthening structure, a further reinforcing can be provided when necessary by using a skeletal reinforcing structure 20*a* extending fore and aft of the ship, or by a skeletal reinforcing structure 20*b* extending across the beam of the ship. Note, the structure 20*a* and 20*b* are preconnected to the inner surface of the sections at the factory 2.

Figure 4:
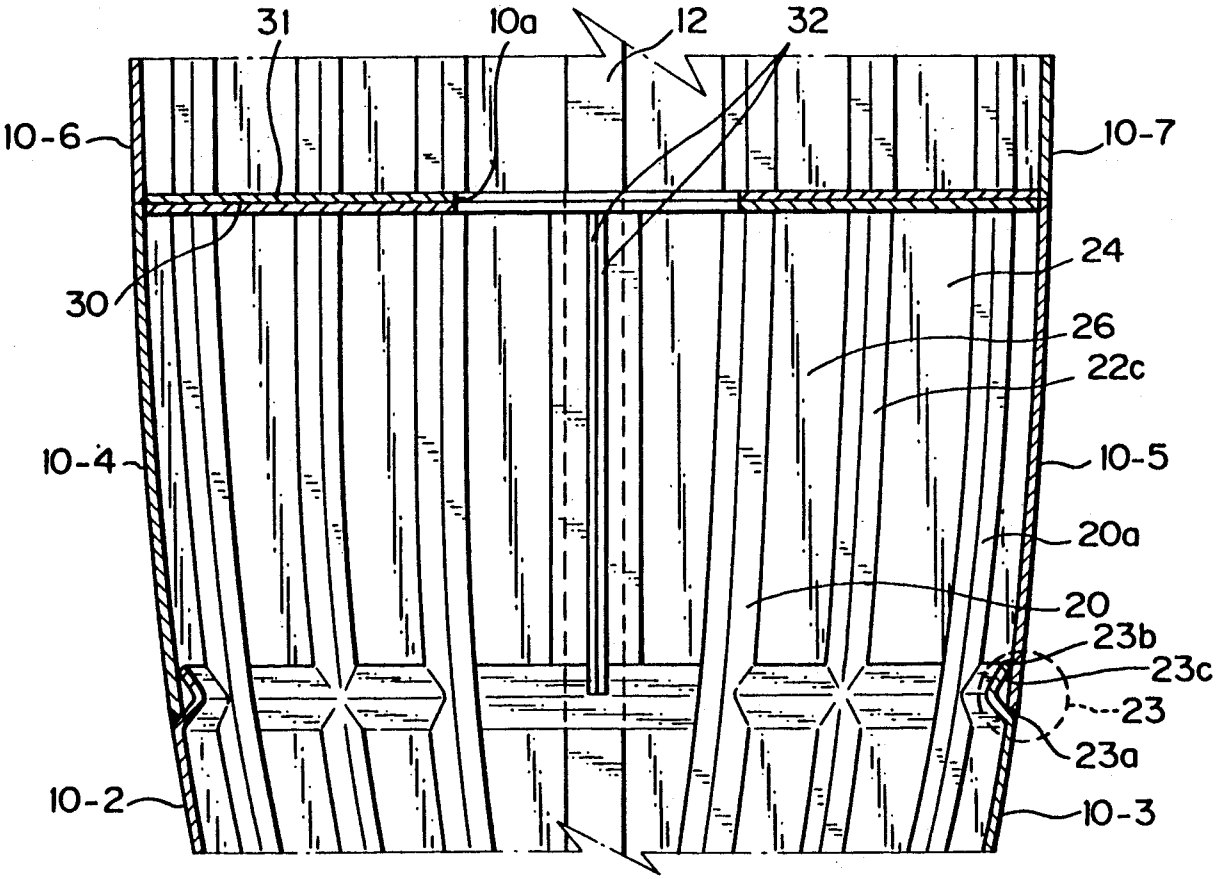
FIG. 4 is a cross sectional view taken along the line IV—IV in FIG. 3.

The method of connecting the sections to each other is now explained. First, a skeletal strengthening structure 23 is located between adjacent sections in the longitudinal direction of the ship. As shown in FIG. 4, the skeletal strengthening structure 23 is arranged between the sections 10-3 and 10-5. A flange portion 23*c* is provided on the block 10-3, at one end thereof in the longitudinal direction, during the stamping-out of this section 10-3. This flange portion 23*c* is connected to the outer panel of the adjacent block 10-5 at welding points 23*a* and 23*b*, whereby a closed strengthening structure is obtained. Note, instead of the closed skeletal structure 23, the sections 10-5 and 10-7 in the longitudinal direction of the ship are connected to each other by transverse bulkheads 30 and 31. Namely, a rear side bulkhead 30 of the section body 10-5 is connected to a front side bulkhead of the section body 10-7. In this case, since these bodies are welded together, except where openings 10-*a* are formed, a strong connection of the front and rear sections is obtained.

Next, a connection of right and left side sections will be described. In this embodiment, a keel 12 is laid from fore to aft of the ship, and each of the blocks is welded so that a closed cross-section skeletal structure is formed with respect to the keel 12. As shown in FIG. 3, the blocks 10-4 and 10-5 are provided with a flange 28*c* which is connected to the keel 12 at welding points 28*a* and 28*b*, so that spaces 28*d* are formed, whereby a closed strengthening structure is obtained. Note, the flanges 28*c* are formed when the section is made at the factory 28.

Although the embodiment as illustrated uses the keel 12, this keel 12 is not required when the ship is very small. In this case, in place of the keel, a skeletal structure which corresponds to the structure 22 is formed between the right side and left side sections.

Where longitudinal bulkheads 32 are also arranged between the left side and right side sections, these bulkheads 32 are welded to each other at suitable points, and thus a much more rigid connection between the right side and left side sections is obtained. In this embodiment, the longitudinal bulkheads 32 are arranged between the blocks 10-4 and 10-5.

In addition to the construction as shown in FIGS. 3 and 4, the skeletal structure having a closed cross-section and located between the outer panels or at the boundaries of the sections can have the construction as shown in FIG. 5.

In the construction as shown in FIG. 5-(A), a flange a is formed on one of the outer panels and a flange b is formed on the other outer panel, and these flanges a and b are welded along the portion d. Thereafter, a third member c is applied thereto and welded along the portions e, whereby a skeletal strengthening structure having a closed cross-section is formed between the outer panels.

In the construction as shown in FIG. 5-(B), a third member c is arranged inside of the ship. This construction allows only one welded portion to appear on the outer surface of the ship body, which facilitates the correction of welding traces.

The construction shown in FIG. 5-(C) provides a skeletal strengthening structure having a closed cross-section without the use of a third member, and as a result, welding distortions can be greatly reduced. Openings f can be formed when necessary, to lower the weight.

FIG. 5-(D) shows a structure having a rectangular closed cross-sectional shape and FIG. 5-(E) shows a structure having a semi-circular closed cross-sectional shape.

These cross-sectional shapes, and the size thereof, can be suitably selected in accordance with the required use.

The constructions shown in the embodiments explained above are particularly suitable for an aluminum boat or steel ship. In particular, when the present construction is applied to an aluminum boat, a lowering of the shipbuilding costs can be obtained such that it is the same as or cheaper than the cost of producing an FRP ship by the conventional method. Therefore, it is expected that the aluminum boat will become popular and replace the FRP boat, since it is easier to maintain and is easily recycled.

The use of the construction according to the present invention allows the many steps required for building a ship to be carried out without regional limitations, thereby obtaining an advantage of the use of a mass production system. Further, since each of production units has a maximum width of at most 2.5 meters, the production system, production techniques, and automation techniques used for automobiles can be applied, thereby obtaining a greater rationalization of the ship production system.

Furthermore, the outer shell of the ship preformed to a desired shape by a plastic deformation process allows the shape of the ship to be designed as desired, and therefore, a short term and low cost production of ship bodies having a high performance and an aesthetically pleasing appearance is realized.

Although the present invention is described with reference to the attached drawings, many modification and changes can be made by those skilled in this art without departing from the scope and spirit of the invention.

I claim:

1. A small ship comprising:

a plurality of prefabricated sections having a size and shape suitable for overland transportation, the sections being connected to each other by welding to obtain a shell of the ship, each of the sections comprising at least one outer plate member of said shape obtained by a plastic deformation process;

skeletal strengthening structures being formed between adjacent outer plate members, each skeletal strengthening structure including an inwardly recessed flange portion of predetermined shape, having an end surface at one end thereof and a base surface spaced from the end surface, wherein the inwardly recessed flange portion is defined between the end surface and the base surface, the flange portion being integrally connected to one outer plate, and welded along the end surface and along the base surface to an adjacent plate, the flange being configured to define a closed space between the flange and the adjacent outer plate, the closed space extends along the length of the sections for obtaining the desired strength of the sections when connected to produce a shell of a small ship.

2. A small ship according to claim 1, having skeletal strengthening structures which extend along the beam of the ship and between adjacent sections.

3. A small ship according to claim 1, wherein each of said plurality of prefabricated sections comprises at least two outer plate members, said skeletal strengthening structure being formed between said adjacent outer plate members which are adjacent to each other along a longitudinal direction of the ship.

4. A small ship according to claim 1, wherein skeletal strengthening structures are formed along the longitudinal direction of the ship between adjacent sections.

5. A small ship according to claim 4, wherein said skeletal strengthening structures form a keel having a substantially T cross sectional shape.

6. A small ship according to claim 1, further comprising at least one longitudinal member connected to each of the sections which are connected to each other.

* * * * *